US008943862B2

(12) United States Patent
Lai

(10) Patent No.: US 8,943,862 B2
(45) Date of Patent: Feb. 3, 2015

(54) COMPOSITE CODED LOCK FOR A BAG

(75) Inventor: Leo Lai, Dongguan (CN)

(73) Assignee: Yifeng Manufacturing Co., Ltd., Dongguan, Guangdong (CN)

( * ) Notice: Subject to any disclaimer, the term of this patent is extended or adjusted under 35 U.S.C. 154(b) by 39 days.

(21) Appl. No.: 13/595,004

(22) Filed: Aug. 27, 2012

(65) Prior Publication Data

US 2014/0033775 A1 Feb. 6, 2014

(30) Foreign Application Priority Data

Aug. 3, 2012 (CN) ..... 2012 2 0382868 U

(51) Int. Cl.
*A45C 13/10* (2006.01)

(52) U.S. Cl.
USPC ..... 70/71; 70/312; 70/284; 70/285

(58) Field of Classification Search
CPC . E05B 37/0034; E05B 65/52; E05B 37/0031; A45C 13/18; A45C 13/10
USPC ..... 70/69–71, 312, 284, 285
See application file for complete search history.

(56) References Cited

U.S. PATENT DOCUMENTS 4,356,712 A * 11/1982 Bako ..... 70/69
4,365,490 A * 12/1982 Manzoni ..... 70/70
4,366,685 A * 1/1983 Remington ..... 70/70
4,395,892 A * 8/1983 Remington ..... 70/312
4,416,126 A * 11/1983 Remington ..... 70/71
4,907,430 A * 3/1990 Hong ..... 70/312
4,914,931 A * 4/1990 Shu ..... 70/213
7,010,945 B2 * 3/2006 Yu ..... 70/71
7,266,980 B1 * 9/2007 Ma ..... 70/69
7,290,417 B1 * 11/2007 Huang ..... 70/285
7,380,427 B2 * 6/2008 Elles et al. ..... 70/285
2006/0162404 A1 * 7/2006 Hsieh ..... 70/71
2007/0193316 A1 * 8/2007 Huang ..... 70/284
2007/0214850 A1 * 9/2007 Ma ..... 70/284
2008/0173050 A1 * 7/2008 Cheng ..... 70/284
2013/0014550 A1 * 1/2013 Xie et al. ..... 70/69
2014/0033775 A1 * 2/2014 Lai ..... 70/285

* cited by examiner

*Primary Examiner* — Suzanne Barrett
(74) *Attorney, Agent, or Firm* — Jackson IPG PLLC

(57) ABSTRACT

The invention relates a composite coded lock for a bag, said lock comprises a central lock hook in the middle, at least one side lock hook, a bottom shell, a locking device, a clamping device and a linkage, wherein the locking device is fixed on a casing and has a key lock and a coded lock; the coded lock has a controlled lock blade which has a limiting portion; the limiting portion is controlled by the key lock and the coded lock to move between an unlocking position and a locking position; the clamping device has a clamping pedestal fixed on one side of the bottom shell; the clamping pedestal is provided with a locking piece clamped with the side lock hook and a push and control block used for controlling the movement of the locking piece; the linkage is arranged on the bottom shell.

9 Claims, 7 Drawing Sheets

COMPOSITE CODED LOCK FOR A BAG

FIELD OF THE INVENTION

The invention relates to a mechanical coded lock, in particular to a composite coded lock for a bag.

BACKGROUND OF THE INVENTION

Currently, locksets applied to bags generally only use coded locks. In the case that the coded lock is used, no key is required, and thus the coded lock is very convenient in use, and consequently a user does not need to worry about the problem that the key is lost or forgotten. However, during the use of the coded lock, the user needs to remember the password. If the coded lock is not used for a long time, the user may forget the password of the coded lock. In the case, the coded lock must be unlocked by force, and then may be damaged.

Moreover, along with the development of the economy, people have more opportunities to go out and carry more and more items. Therefore, when going out, people tend to carry longer and larger bags. In general, a coded lock is arranged on one side of a lower casing of a bag and a lock hook is arranged in the middle or lock hooks are arranged at both ends of a corresponding side face of an upper casing of the bag. The bag is locked via the engagement of the lock hook(s) and the coded lock. As the bag has certain flexibility, if the upper casing and the lower casing of the bag are fixedly connected with each other only through the lock hook in the middle, both sides of the bag can be easily pried up by foreign objects, and then items can be stolen. If the upper casing and the lower casing of the bag are fixedly connected with each other through the lock hooks at both ends, the central section of the bag may be pried up.

SUMMARY OF THE INVENTION

The objective of the invention is to overcome the defects in the prior art and provide a composite coded lock for a bag, wherein firstly, the coded lock can be unlocked by a key or a password, and thus is convenient in use; and secondly, the coded lock can have two or three lock hooks according to the dimension of the bag, and thus the use safety of the bag can be improved.

In order to achieve the objective, the invention adopts the technical proposal that:

The invention relates to a composite coded lock for a bag, which comprises:

a central lock hook in the middle and at least one side lock hook;

a bottom shell, in which a bottom shell through hole for a hook portion of the central lock hook to be inserted into is formed in the middle of the bottom shell;

a locking device, in which the locking device is fixed on a casing and has a key lock and a coded lock; the key lock has a rotatable lock core and is disposed on one side of the coded lock; the coded lock has a controlled lock blade which has a limiting portion; the limiting portion of the lock blade is disposed at an unlocking position in the case of correct password and at a locking position in the case of incorrect password; the locking position of the limiting portion is in the moving direction of the hook portion of the central lock hook; a controlled portion is extended out of the lock blade towards the direction of the lock core of the key lock; in the case of unlocking the lock core, the lock core is connected with the controlled portion of the lock blade and the limiting portion of the lock blade is controlled by the controlled portion to enter into the unlocking position; and in the case of locking the lock core, the limiting portion of the lock blade is controlled by the controlled portion to enter into the locking position;

a clamping device, in which the clamping device is engaged with the side lock hook and has a clamping pedestal fixed on one side of the bottom shell; a side through hole for the side lock hook to be inserted into is formed on one side of the clamping pedestal; and the clamping pedestal is provided with a locking piece clamped with the side lock hook and a push and control block used for controlling the movement of the locking piece; and a linkage, in which the linkage is arranged on the bottom shell; one end of the linkage is butted or connected with the push and control block and the other end of the linkage is disposed on one side of the unlocking position; when the limiting portion of the lock blade is at the locking position, the limiting portion is in the moving direction at the other end of the linkage, which is limited by the limiting portion, and then the push and control block is limited on the clamping pedestal and the locking piece is clamped with the side lock hook; when the limiting portion of the lock blade is at the unlocking position, the other end of the linkage is movable and the push and control block is movable and drives the locking piece and the side lock hook to be disengaged from each other.

Wherein, the bottom shell has a lock core casing fixedly connected therewith; spacers are arranged on both sides of the lock core casing; the coded lock has password wheels, password adjustment wheels and a cross pin; each password adjustment wheel has a first annular section and a second annular section; the outside diameter of the first annular section is more than that of the second annular section; a plurality of clamping bodies are extended out of the end face of the first annular section towards the second annular section; annularly distributed clamping holes engaged with the clamping bodies are formed on the inner side face of each password wheel which is sleeved on the second annular section of the password adjustment wheel; the clamping bodies are extended into the clamping holes; the spacers are provided with mounting holes for the cross pin to be mounted into; both ends of the cross pin are respectively sleeved into the mounting holes of the spacers; the lock blade has a fixing portion disposed on one side and fixedly connected with the lock core casing, a connecting portion disposed in the middle, and a limiting portion disposed on the other side; the lock blade is arranged under the password adjustment wheels; the connecting portion of the lock blade is provided with through holes for the password wheels to pass through; intermediate connecting pieces are arranged on one sides of the through holes; grooves are formed on side faces of the first annular sections of the password adjustment wheels; central sections of the intermediate connecting pieces are protruded towards the direction of the password adjustment wheels to form projections engaged with the grooves; an elastic component for ejecting the lock blade is arranged between the lock blade and the lock core casing; and the intermediate connecting pieces are butted with the side faces of the first annular sections of the password adjustment wheels.

Wherein, a password adjustment rod and a password adjustment spring are respectively sleeved on both sides of the cross pin; both the lock core casing and the bottom shell are provided with a password adjustment hole for the end portion of the password adjustment rod to be exposed; and both ends of the password adjustment spring are butted with the first annular sections of the password adjustment wheels and the corresponding spacer respectively.

Wherein, the lock core of the key lock is fixed on the bottom shell through a lock sleeve of the key lock and disposed on one side of the lock core casing; and a push block used for pushing the controlled portion of the lock blade is formed on the end portion of the lock core.

Wherein, the controlled portion has an inclined plane engaged with the push block or the push block has an inclined plane engaged with the controlled portion.

Wherein, the clamping pedestal also has a surface shell; one end of the locking piece close to the locking device is articulated with one end of the surface shell; both the locking piece and the surface shell are provided with coaxial through holes; pin shafts are inserted into the through holes, so that the locking piece is articulated with the surface shell; the other end of the surface shell is slideably connected with the push and control block which has a clamping portion; the clamping pedestal is provided with a clamping hole engaged with the clamping portion which is butted with one end of the linkage; the linkage prevents the clamping portion of the push and control block from being removed from the clamping hole; a connecting piece is formed between the surface shell and the locking piece and lapped with the locking piece; one end of the connecting piece far away from the locking device is a fixed end having a shoulder; a connecting block is formed between the shoulder and the surface shell; both ends of the connecting block are respectively articulated with the central section of the surface shell and the shoulder; and the connecting piece is connected with the clamping pedestal.

Wherein, the fixed end of the connecting piece is curved towards the surface shell to form a stop block; a fixing rod is arranged between the connecting piece and the surface shell; both ends of the fixing rod are fixed on the clamping pedestal; and the fixing rod is clamped with the stop block of the fixed end.

Wherein, the composite coded lock for a bag also comprises a main surface shell and side surface shells, which are engaged with the bottom shell, and a handle; a through hole for the password wheels and the lock core to be exposed is formed in the middle of the main surface shell; mounting holes for the handle to be mounted into are formed on both sides of the main surface shell; and the handle is articulated with the main surface shell through the mounting holes.

Wherein, the linkage comprises a movable plate, a clutch block, a drive plate and a control plate which are engaged with the limiting portion of the lock blade; the clutch block is provided with an axle hole; the bottom shell is provided with a dead axle engaged with the axle hole; two driving parts are arranged on the side face of the clutch block and disposed on the same side with the axle hole; a torsion spring sleeved on the dead axle is arranged inside the axle hole; both ends of the torsion spring are respectively connected with the clutch block and the bottom shell; one end of the movable plate is disposed on one side of the limiting portion of the lock blade and the other end of the movable plate is butted with one driving part of the clutch block; one end of the drive plate is butted with the other driving part of the clutch block and the other end of the drive plate is connected with one end of the control plate; a control block connected with the control plate is formed at the other end of the control plate and butted with the push and control block; and the limiting portion of the lock blade has a push-out inclined plane which makes contact with the movable plate.

Wherein, an offsetting elastic component is arranged between the linkage and the bottom shell or the clamping pedestal.

The composite coded lock for a bag has the advantages that: corresponding side lock hooks can be arranged according to the dimension of the bag and the side lock hooks and the central lock hook are matched with each other in use, and thus the bag is safer in use; and meanwhile, the key lock and the coded lock are integrated, so that the composite coded lock for a bag can be unlocked both by the password and the key, and thus the bag is more convenient in use.

DETAILED DESCRIPTION OF THE PREFERRED EMBODIMENTS

Further description is given to the invention with the attached drawings and preferred embodiments.

Figure 4:
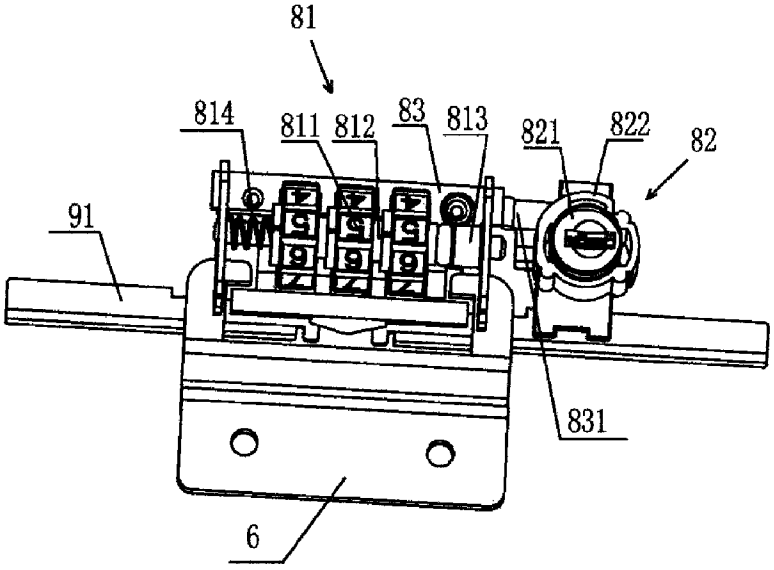
FIG. 4 is a schematic diagram illustrating the engagement between the locking device of which a lock core casing is removed and a drive plate and a central lock hook.
Figure 6:
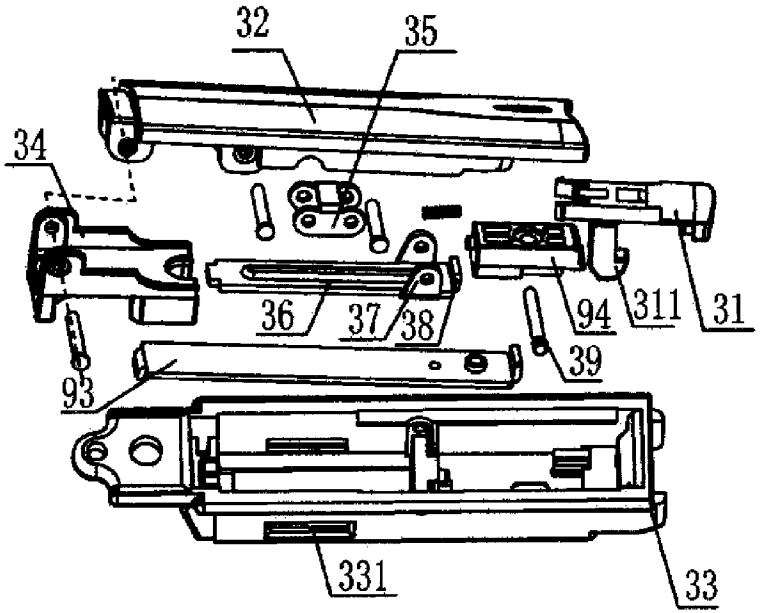
FIG. 6 is an exploded view of the internal structure of a clamping device of the composite coded lock for a bag.
Figure 9:
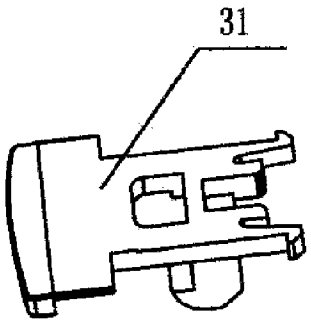
FIG. 9 is a structure diagram of the lock blade of the composite coded lock for a bag.
Figure 12:
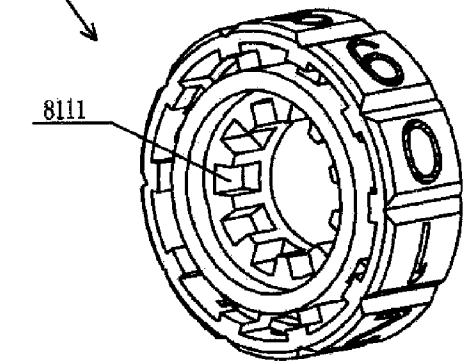
FIG. 12 is a structure diagram of a password wheel of the composite coded lock for a bag.
Figure 11:
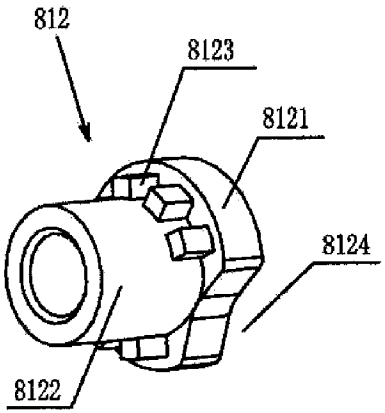
FIG. 11 is a structure diagram of a password adjustment wheel of the composite coded lock for a bag.

Embodiment: as illustrated in FIGS. 1 to 13, the invention relates to a composite coded lock for a bag, which comprises:

a central lock hook 6 in the middle and at least one side lock hook 4;

a bottom shell 7, in which a bottom shell through hole for a hook portion of the central lock hook 6 to be inserted into is formed in the middle of the bottom shell 7;

a locking device 8, in which the locking device 8 is fixed on a casing and has a key lock 82 and a coded lock 81; the key lock 82 has a rotatable lock core 821 and disposed on one side of the coded lock 81; the coded lock 81 has a controlled lock blade 83 which has a limiting portion 833; the limiting portion 833 of the lock blade 83 is disposed at an unlocking position in the case of correct password and at a locking position in the case of incorrect password; the locking position of the limiting portion 833 is in the moving direction of the hook portion of the central lock hook 6 (as illustrated in FIG. 4); a controlled portion 831 is extended out of the lock blade 83 towards the direction of the lock core 821 of the key lock 82; in the case of unlocking the lock core 821, the lock core 821 is connected with the controlled portion 831 of the lock blade 83 and the limiting portion 833 of the lock blade 83 is controlled by the controlled portion 831 to enter into the unlocking position; and in the case of locking the lock core 821, the limiting portion 833 of the lock blade 83 is controlled by the controlled portion 831 to enter into the locking position;

a clamping device 3, in which the clamping device 3 is engaged with the side lock hook 4 and has a clamping pedestal 33 fixed on one side of the bottom shell 7; a side through hole for the side lock hook 4 to be inserted into is formed on one side of the clamping pedestal 33; and the clamping pedestal 33 is provided with a locking piece 34 clamped with the side lock hook 4 and a push and control block 31 used for controlling the movement of the locking piece 34 (as illustrated in FIG. 6); and a linkage 9, in which the linkage 9 is arranged on the bottom shell 7; one end of the linkage 9 is butted or connected with the push and control block 31 and the other end of the linkage is disposed on one side of the unlocking position; when the limiting portion 833 of the lock blade 83 is at the locking position, the limiting portion 833 is in the moving direction at the other end of the linkage 9, which is limited by the limiting portion 833, and then the push and control block 31 is limited on the clamping pedestal 33 and the locking piece 34 is clamped with the side lock hook 4; when the limiting portion 833 of the lock blade 83 is at the unlocking position, the other end of the linkage 9 is movable and the push and control block 31 is movable and drives the locking piece 34 and the side lock hook 4 to be disengaged from each other.

Figure 1:
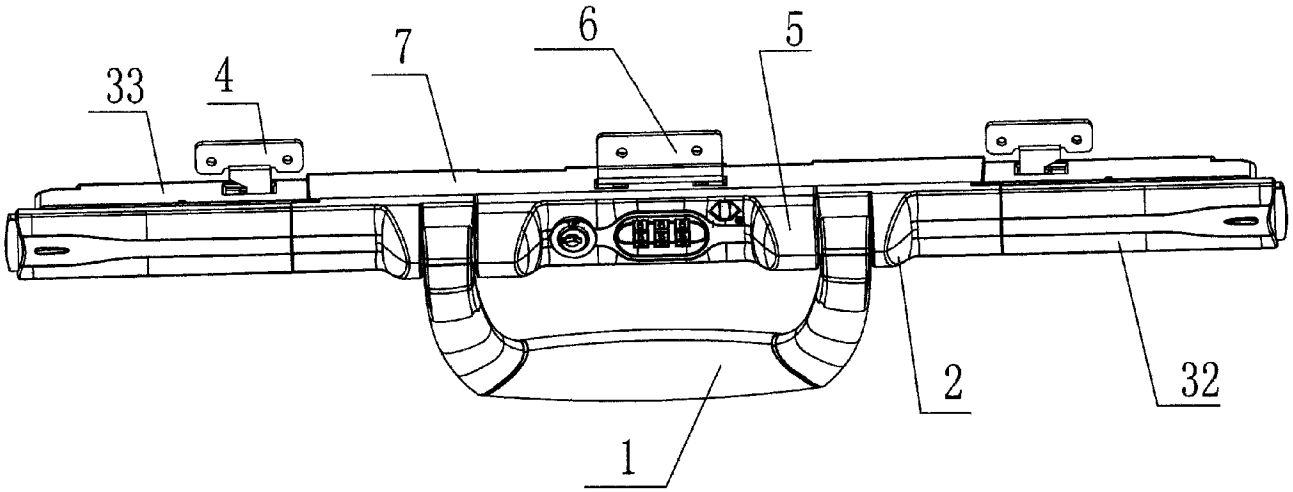
FIG. 1 is a structure diagram of the composite coded lock for a bag.
Figure 2:
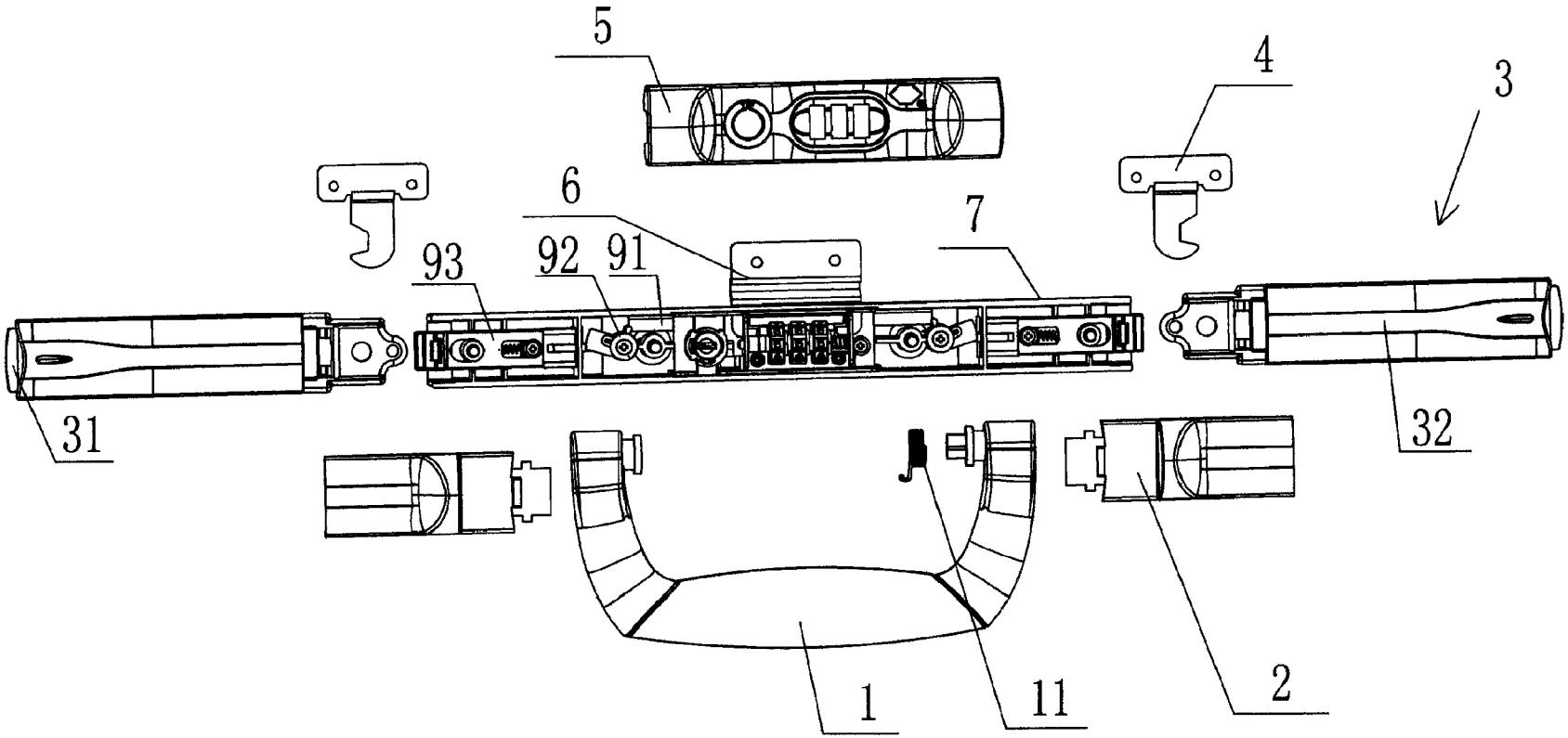
FIG. 2 is an exploded view of the composite coded lock for a bag.

In the technical proposal of the application, the side lock hook 4 and the clamping device 3 of the composite coded lock 81 can be designed according to the dimension of the bag. When the bag is not long, the side lock hook 4 and the clamping device 3 can be only designed on one side of the bag. When the bag is relatively long, the side lock hook 4 and the clamping device 3 can be designed on both sides of the bag respectively (as illustrated in FIGS. 1 and 2). The technical proposal can meet the requirements of bags with different lengths. In the technical proposal, the key lock 82 and the coded lock 81 respectively control the positions of the limiting portion 833 of the lock blade 83. The limiting portion 833 can be driven to enter into the unlocking position by a key or by rotating password wheels 811, and then the unlocking can be realized, and consequently convenience is brought to users by means of the key and a password together. In addition, the limiting portion 833 of the lock blade 83 controls the movement of the central lock hook 6 and the linkage 9 which controls the movement of the push and control block 31 and the locking piece 34, and the locking piece 34 controls the movement of the side lock hook 4. Therefore, the limiting portion 833 of the lock blade 83 controls the movement of the central lock hook 6 and the side lock hook 4, and then the connection relation of the central lock hook 6 and the side lock hook 4 can be controlled by the limiting portion 833 of the lock blade 83.

Figure 5:
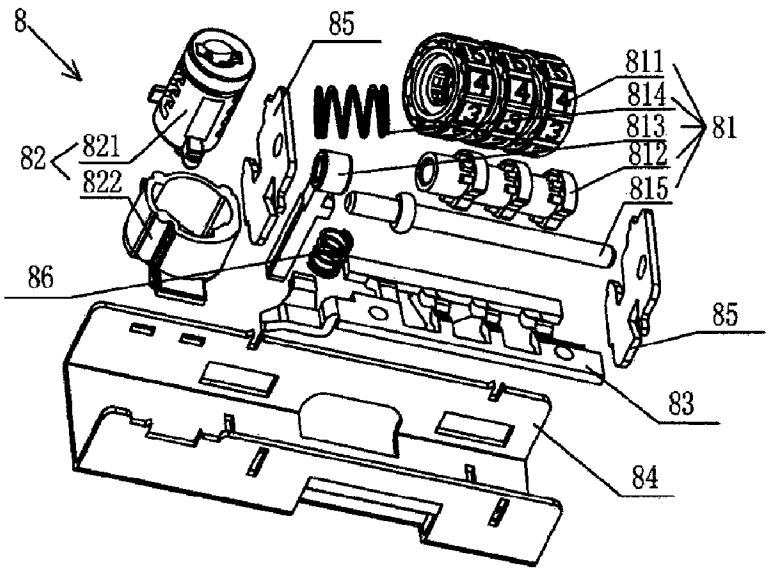
FIG. 5 is an exploded structure diagram of the locking device of the composite coded lock for a bag.

Wherein, as illustrated in FIGS. 5 and 2, the bottom shell 7 has a lock core casing 84 fixedly connected therewith; spacers 85 are arranged on both sides of the lock core casing 84; the coded lock 81 has the password wheels 811, password adjustment wheels 812 and a cross pin 815; each password adjustment wheel 812 has a first annular section 8121 and a second annular section 8122; the outside diameter of the first annular section 8121 is more than that of the second annular section 8122; a plurality of clamping bodies 8123 are extended out of the end face of the first annular section 8121 towards the second annular section 8122; annularly distributed clamping holes 8111 engaged with the clamping bodies 8123 are formed on the inner side face of each password wheel 811 which is sleeved on the second annular section 8122 of the password adjustment wheel 812; the clamping bodies 8123 are extended into the clamping holes 8111; the spacers 85 are provided with mounting holes for the cross pin 815 to be mounted into; both ends of the cross pin 815 are respectively sleeved into the mounting holes of the spacers 85; the lock blade 83 has a fixing portion 832 disposed on one side and fixedly connected with the lock core casing 84, a connecting portion disposed in the middle, and the limiting portion 833 disposed on the other side and is arranged under the password adjustment wheels 812; the connecting portion of the lock blade 83 is provided with through holes 8342 for the password wheels 811 to pass through; intermediate connecting pieces 36 are formed on one sides of the through holes 8342; grooves 8124 are formed on side faces of the first annular sections 8121 of the password adjustment wheels 812; central sections of the intermediate connecting pieces 36 are protruded towards the direction of the password adjustment wheels 812 to form projections 8343 engaged with the grooves 8124; an elastic component 86 for ejecting the lock blade 83 is arranged between the lock blade 83 and the lock core casing 84; and the intermediate connecting pieces 36 are butted with the side faces of the first annular sections 8121 of the password adjustment wheels 812.

In the coded lock 81 of the technical proposal, the password adjustment wheels 812 are driven to rotate by the password wheels 811. When the password adjustment wheels 812 rotate, the movement of the limiting portion 833 of the lock blade 83 is controlled via the engagement between the grooves 8124 on the side faces of the password adjustment wheels 812 and the projections 8343 of the intermediate connecting pieces 36, and then the unlocking and locking can be realized. In the case of correct password, the grooves 8124 of the password adjustment wheels 812 are engaged with the projections 8343 of the lock blade 83, namely the projections 8343 of the lock blade 83 all enter into the grooves 8124 of the password adjustment wheels 812; the lock blade 83 pushes the limiting portion 833 of the lock blade 83 towards the direction of the bottom shell 7 via the elastic force of the elastic component 86 which is a spring in the embodiment; and then the limiting portion 833 of the lock blade 83 enters into the unlocking position. In the case of incorrect password, the groove 8124 of at least one password adjustment wheel 812 is not engaged with the projection of the corresponding intermediate connecting piece 36 and the first annular section 8121 of the password adjustment wheel 812 is butted with the corresponding intermediate connecting piece 36 and presses the corresponding intermediate connecting piece 36 towards the direction of the bottom shell 7, and then the limiting portion 833 of the lock blade 83 enters into the locking position. As illustrated in FIG. 4, herein the limiting portion 833 prevents the central lock hook 6 from being removed and prevents the linkage of the linkage 9.

Moreover, a password adjustment rod 813 and a password adjustment spring 814 are respectively sleeved on both sides of the cross pin 815; both the lock core casing 84 and the bottom shell 7 are provided with a password adjustment hole 71 for the end portion of the password adjustment rod 813 to be exposed; and both ends of the password adjustment spring 814 are respectively butted with the first annular sections 8121 of the password adjustment wheels 812 and the corresponding spacer 85 (as illustrated in FIGS. 4 and 5).

The password adjustment rod 813 and the password adjustment spring 814 can assist a cipher device in password adjustment. When the password is adjusted to be correct, all the grooves 8124 of the password adjustment wheels 812 are engaged with the projections 8343 of the intermediate connecting pieces 36; the password adjustment rod 813 is pushed and drives the password adjustment wheels 812 to move towards one side of the cross pin 815 and compresses the password adjustment spring 814; and herein lower ends of the password wheels 811 are clamped into the through holes 8342 of the lock blade 83 and cannot move. When the password adjustment rod 813 moves to a certain distance (the distance can be realized by the design of the width of the password adjustment hole 71), the clamping bodies 8123 of the first annular sections 8121 of the password adjustment wheels 812 are removed from the clamping holes 8111 on inner side faces of the password wheels 811, and herein the password adjustment can be realized by the rotation of the password wheels 811. After the password adjustment, the password adjustment rod 813 is released; the password adjustment wheels 812 move and reset under the thrust force of the password adjustment spring 814; the clamping bodies of the first annular sections 8121 of the password adjustment wheels 812 enter into the clamping holes 8111 on the inner side faces of the password wheels 811 again; and then the password change is realized.

Furthermore, the lock core 821 of the key lock 82 is fixed on the bottom shell 7 through a lock sleeve 822 of the key lock 82 and disposed on one side of the lock core casing 84, and a push bock for pushing the controlled portion 831 of the lock blade 83 is formed on the end portion of the lock core 821.

Still further, the controlled portion 831 has an inclined plane 8311 engaged with the push block or the push block has an inclined plane engaged with the controlled portion 831.

Figure 8:
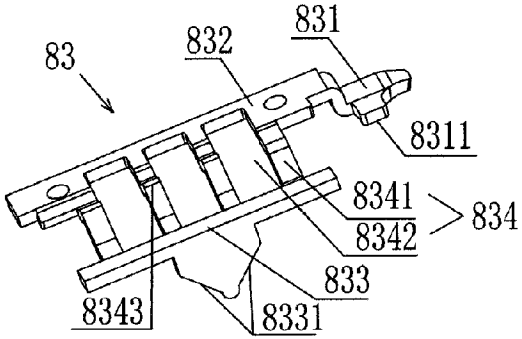
FIG. 8 is a structure diagram of a lock blade of the composite coded lock for a bag.
Figure 10:
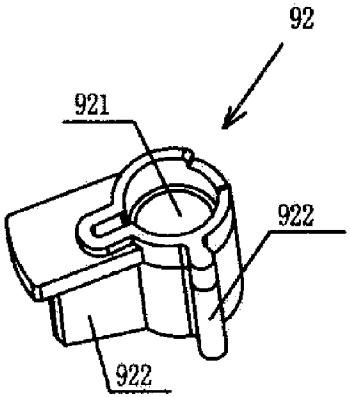
FIG. 10 is a structure diagram of a clutch block of the composite coded lock for a bag.
Figure 13:
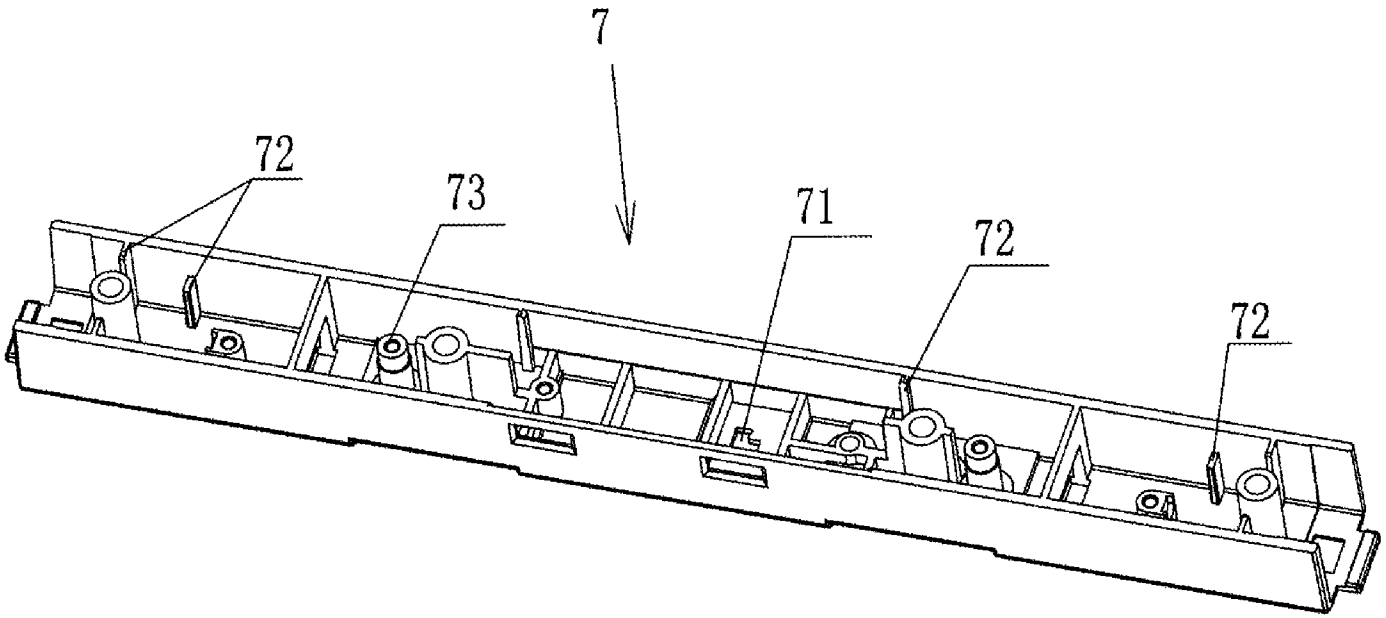
FIG. 13 is a structure diagram of a bottom shell of the composite coded lock for a bag.

Due to the design of the inclined plane 8311, the push block gradually pushes the connecting portion when engaged with the controlled portion 831, and then can more conveniently make contact with the controlled portion 831. In the technical proposal, as illustrated in FIG. 8, a contact surface of the controlled portion 831 and the push block is designed to be the inclined plane 8311.

Furthermore, the clamping pedestal 33 also has a surface shell 32, and one end of the locking piece 34 close to the locking device 8 is articulated with one end of the surface shell 32. In the embodiment, as illustrated in FIG. 6, both the locking piece 34 and the surface shell 32 are provided with coaxial through holes; pin shafts are inserted into the through holes, so that the locking piece 34 is articulated with the surface shell 32; the other end of the surface shell 32 is slideably connected with the push and control block 31 which has a clamping portion 311; the clamping pedestal 33 is provided with a clamping hole engaged with the clamping portion 311; the clamping portion 311 is butted with one end of the linkage 9 which prevents the clamping portion 311 of the push and control block 31 from being removed from the clamping hole; a connecting piece 8341 is formed between the surface shell 32 and the locking piece 34 and lapped with the locking piece 34; one end of the connecting piece 8341 far away from the locking device 8 is a fixed end 38 having a shoulder 37; a connecting block 35 is formed between the shoulder 37 and the surface shell 32; two ends of the connecting block 35 are respectively articulated with the central section of the surface shell 32 and the shoulder 37; and the connecting piece 8341 is connected with the clamping pedestal 33.

In the technical proposal, the push and control block 31 is connected with the locking piece 34 through the surface shell 32. In the case of locking, the clamping portion 311 of the push and control block is clamped into the clamping hole of the clamping pedestal 33. As the linkage 9 is limited by the limiting portion 833 of the lock blade 83 and cannot move, the push and control block 31 is limited by the linkage 9 and cannot move, and then both the surface shell 32 and the locking piece 34 cannot move and the locking piece 34 and the side lock hook 4 maintain the state of being clamped with each other. After unlocking, the push and control block 31 can be pushed and moves towards the direction of the locking device 8 and drives the linkage and the clamping portion 311 of the push and control block 31 to be removed from the clamping hole of the clamping pedestal 33. As the surface shell 32 is articulated with the locking piece 34, the surface shell 32 can rotate around one end of the surface shell 32 close to the locking device 8. The surface shell 32, the locking piece 34, the connecting block 35 and the clamping pedestal 33 form a crank block structure. When the surface shell 32 rotates, the locking piece 34 is driven to slide on the clamping pedestal 33, so that the locking piece 34 is disengaged from a hook portion of the side lock hook 4, and then the unlocking is realized.

Figure 7:
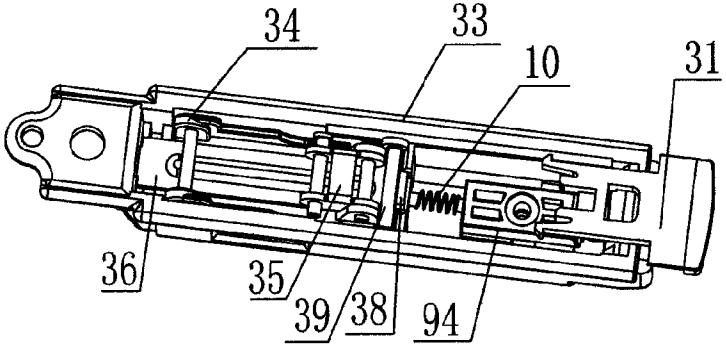
FIG. 7 is a structure diagram of the clamping device of which a surface shell is removed, of the composite coded lock for a bag.

Furthermore, the fixed end 38 of the connecting piece 8341 is curved towards the surface shell 32 to form a stop block; a fixing rod 39 is arranged between the connecting piece 8341 and the surface shell 32; both ends of the fixing rod 39 are fixed on the clamping pedestal 33; and the fixing rod 39 is clamped with the stop block of the fixed end 38 (as illustrated in FIG. 7).

The connecting piece 8341 is fixed between the fixing rod 39 and the locking piece 34 via the arrangement of the fixing rod 39, and a limited end of the connecting piece 8341 is clamped by the fixing rod 39 and cannot move. When the surface shell 32 rotates, the connecting block 35 also rotates and meanwhile the locking piece 34 moves along the clamping pedestal 33, and then the crank block structure is formed.

Furthermore, as illustrated in FIGS. 1 and 2, the composite coded lock 81 for the bag also comprises a main surface shell and side surface shells 2, which are engaged with the bottom shell 7, and a handle 1 (as illustrated in FIGS. 1 and 2). A through hole for the password wheels 811 and the lock core 821 to be exposed is formed in the middle of the main surface shell 5; mounting holes for the handle 1 to be mounted into are formed on both sides of the main surface shell 5; and the handle 1 is articulated with the main surface shell 5 through the mounting holes.

The coded lock 2, the key lock and the linkage are sealed into a receiving space in the bottom shell 7 via the arrangement of the main surface shell 5 and the side surface shells 2. The arrangement of the handle is favorable for the assistant carrying of the bag. Wherein, a handle torsion spring 11 is also arranged on one end portion of the handle 1. The handle 1 is kept close to the bag via the rotary force of the handle torsion spring 11, and then the situation that the handle 1 shakes freely can be avoided.

Figure 3:
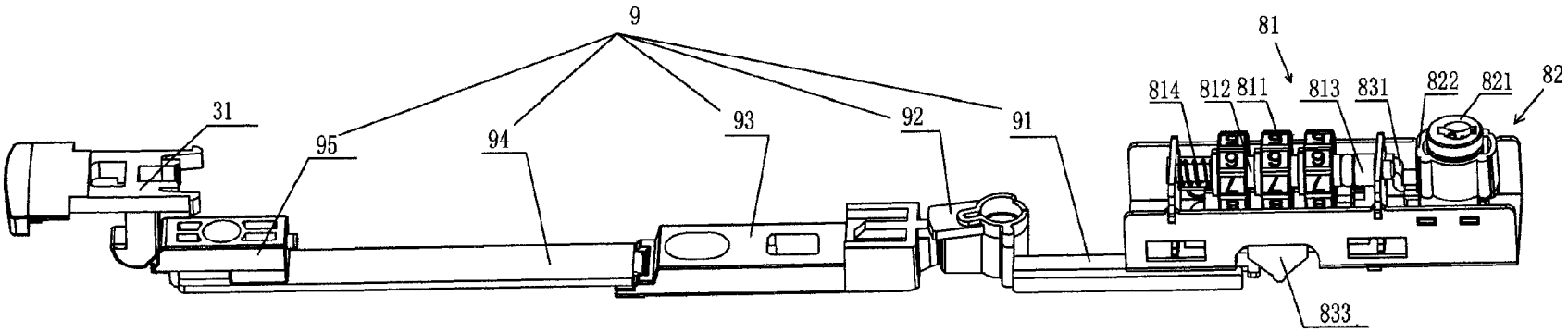
FIG. 3 is a schematic diagram of a locking device, a drive mechanism and a drive mechanism for a push and control block, of the composite coded lock for a bag.

Furthermore, the linkage 9 comprises a movable plate 91, a clutch block 92, a drive plate 93 and a control plate 94 which are engaged with the limiting portion 833 of the lock blade 83, wherein the clutch block 92 is provided with an axle hole 921; the bottom shell 7 is provided with a dead axle 73 engaged with the axle hole 921; two driving parts 922 are arranged on the side face of the clutch block and disposed on the same side with the axle hole 921; a torsion spring sleeved on the dead axle 73 is arranged inside the axle hole 921; both ends of the torsion spring are respectively connected with the clutch block 92 and the bottom shell 7; one end of the movable plate 91 is disposed on one side of the limiting portion 833 of the lock blade 83 and the other end of the movable plate 91 is butted with one driving part 922 of the clutch block 92; one end of the drive plate 93 is butted with the other driving part 922 of the clutch block 92 and the other end of the drive plate 93 is connected with one end of the control plate 94 of which the other end is provided with a control block 95 connected therewith; the control block 95 is butted with the push and control block 31; and the limiting portion 833 of the lock blade 83 has a push-out inclined plane 8331 which makes contact with the movable plate 91 (as illustrated in FIGS. 2, 3 and 8).

The movable plate 91 of the linkage 9 is connected with the drive plate 93 through the clutch block 92 and the two driving parts 922 of the clutch block 92 are disposed on the same side with the axle hole 921, so that the moving direction of the movable plate 91 is the same with that of the drive plate 93. After the movable plate 91 is limited by the lock blade 83, the drive plate 93 is also limited, and then the push and control block 31 is limited and cannot move. When the limiting portion 833 of the lock blade 83 is removed from the moving direction of the movable plate 91, the push and control block 31 can be pushed towards the direction of the locking device 8; the clamping portion 311 of the push and control block 31 is removed from the clamping hole of the clamping pedestal 33; the control block 95 is pushed by the push and control block 31 to move towards the locking device 8; the surface shell 32 is pulled outwards and drives the locking piece 34 to move; and the locking piece 34 is disengaged from the side lock hook 4, and then the unlocking is realized. When the side lock hook 4 is required to be locked, the side lock hook is inserted into the clamping pedestal 33, and the surface shell 32 and the clamping pedestal 33 are covered through the push and control block 31. Herein, the password is messed up; the lock core 821 of the key lock 82 rotates to the locking position; the limiting portion 833 of the lock blade 83 is pressed to the locking position by the password adjustment wheels 812 of the coded lock 81; the push-out inclined plane 8331 of the limiting portion 833 of the lock blade 83 is butted with one end of the movable plate 91 and gradually pushes away the movable plate 91; the other end of the movable plate 91 is restored to the state of being butted with one driving part 922 of the clutch block 92; herein the push and control block 31 is limited, and the side lock hook 4 is locked; and meanwhile, the hook portion of the central lock hook 6 is limited by the limiting portion 833 of the lock blade 83, and the central lock hook 6 is locked (as illustrated in FIG. 3). In the technical proposal, the movement of the linkage 9 can be only directly controlled by the lock blade 83. As an equivalent deformation of the technical proposal, the linkage 9 can be directly replaced by a drive rod. One end of the drive rod is engaged with the limiting portion 833 of the lock blade 83 and the other end of the drive rod is butted with the push and control block 31. Wherein, the torsion spring sleeved on the dead axle 73 is arranged inside the axle hole 921. Under the action of the torsion spring, one driving part 922 of the clutch block 92 is always butted with the other end of the movable plate 91, and the situation that the other driving part of the clutch block 92 and the drive plate 93 are in a straight line after locking is avoided. Moreover, the clutch block 92 cannot rotate and reset under the thrust force of the drive plate 93, and then the situation that the linkage 9 is clamped can be caused.

Furthermore, an offsetting elastic component 10 is arranged between the linkage 9 and the bottom shell 7 or the clamping pedestal 33.

More specifically, the offsetting elastic component 10 is arranged between the control block 95 and the clamping pedestal 33.

Due to the arrangement of the offsetting elastic component 10, the control block 95 is kept to push against the push and control block 31, and then the push and control block 31 is kept to be clamped with the clamping pedestal 33. Therefore, the clamping portion 311 of the push and control block 31 can conveniently enter into the clamping hole of the clamping pedestal 33 when the surface shell 32 and the clamping pedestal 33 are covered. As a deformation of the technical proposal, the offsetting elastic component 10 can be arranged between the linkage 9 and the bottom shell 7 (as illustrated in FIG. 2).

Furthermore, the bottom shell 7 is provided with guide blocks 72 for the drive plate 93 and the movable plate 91 to perform directional movement.

Due to the design of the guide blocks 72, the drive plate 93 and the movable plate 91 cannot shake when moving and can perform directional movement, and then the linkage 9 can operate normally. In like manner, guide blocks 72 for the control plate 94 to perform directional movement are formed in the clamping pedestal 33.

The above is only the preferred embodiments of the application. Equivalent technical proposals on the basis are still within the scope of protection of the application.

What is claimed is:

1. A composite coded lock for a bag, comprising:

a central lock hook and at least one side lock hook;

a bottom shell with a through hole for a hook portion of the central lock hook to be inserted into formed in the middle of the bottom shell;

a locking device fixed on a casing and having a key lock and a coded lock; the key lock having a rotatable lock core and disposed on one side of the coded lock; the coded lock having a controlled lock blade having a limiting portion; the limiting portion of the lock blade disposed at an unlocking position in the case of correct password and at a locking position in the case of incorrect password; the locking position of the limiting portion being in the moving direction of the hook portion of the central lock hook; a controlled portion extended out of the lock blade towards the direction of the lock core of the key lock; in the case of unlocking the lock core, the lock core connected with the controlled portion of the lock blade and the limiting portion of the lock blade controlled by the controlled portion to enter into the unlocking position; and in the case of locking the lock core, the limiting portion of the lock blade controlled by the controlled portion to enter into the locking position, wherein the limiting portion of the lock blade is controllable between the locking position and the unlocking position by actuation of either the key lock or the coded lock;

a clamping device, the clamping device engaged with the side lock hook and having a clamping pedestal fixed on one side of the bottom shell; a through hole for the side lock hook to be inserted into formed on one side of the clamping pedestal; and the clamping pedestal provided with a locking piece clamped with the side lock hook and a push and control block used for controlling the movement of the locking piece; and a linkage, the linkage arranged on the bottom shell; one end of the linkage butted or connected with the push and control block and the other end of the linkage disposed on one side of the unlocking position; when the limiting portion of the lock blade is at the locking position, the limiting portion is in the moving direction at the other end of the linkage, which is limited by the limiting portion, and then the push and control block are limited on the clamping pedestal and the locking piece clamped with the side lock hook; when the limiting portion of the lock blade is at the unlocking position, the other end of the linkage is movable and the push and control block are movable and drive the locking piece and the side lock hook to be disengaged from each other, wherein the linkage comprises a movable plate, a clutch block, a drive plate and a control plate which are engaged with the limiting portion of the lock blade; the clutch block is provided with an axle hole; the bottom shell is provided with a dead axle engaged with the axle hole; two driving parts are arranged on the side face of the clutch block and disposed on the same side with the axle hole; a torsion spring is sleeved on the dead axle inside the axle hole; both ends of the torsion spring are respectively connected with the clutch block and the bottom shell; one end of the movable plate is disposed on one side of the limiting portion of the lock blade and the other end of the movable plate is butted with one driving part of the clutch block; one end of the drive plate is butted with the other driving part of the clutch block and the other end of the drive plate is connected with one end of the control plate; a control block connected with the control plate is formed at the other end of the control plate and butted with the push and control block; and the limiting portion of the lock blade has a push-out inclined plane which makes contact with the movable plate.

2. The composite coded lock for a bag according to claim 1, wherein the bottom shell has a lock core casing fixedly connected therewith; spacers are arranged on both sides of the lock core casing; the coded lock has password wheels, password adjustment wheels and a cross pin; each password adjustment wheel has a first annular section and a second annular section; the outside diameter of the first annular section is more than that of the second annular section; a plurality of clamping bodies are extended out of the end face of the first annular section towards the second annular section; annularly distributed clamping holes engaged with the clamping bodies are formed on the inner side face of each password wheel which is sleeved on the second annular section of the password adjustment wheel; the clamping bodies are extended into the clamping holes; the spacers are provided with mounting holes for the cross pin to be mounted into; both ends of the cross pin are respectively sleeved into the mounting holes of the spacers; the lock blade has a fixing portion disposed on one side and fixedly connected with the lock core casing, a connecting portion disposed in the middle, and a limiting portion disposed on the other side; the lock blade is arranged under the password adjustment wheels; the connecting portion of the lock blade is provided with through holes for the password wheels to pass through; intermediate connecting pieces are arranged on one sides of the through holes; grooves are formed on side faces of the first annular sections of the password adjustment wheels; central sections of the intermediate connecting pieces are protruded towards the direction of the password adjustment wheels to form projections engaged with the grooves; an elastic component for ejecting the lock blade is arranged between the lock blade and the lock core casing; and the intermediate connecting pieces are butted with the side faces of the first annular sections of the password adjustment wheels.

3. The composite coded lock for a bag according to claim 2, wherein a password adjustment rod and a password adjustment spring are respectively sleeved on both sides of the cross pin; both the lock core casing and the bottom shell are provided with a password adjustment hole for the end portion of the password adjustment rod to be exposed; and both ends of the password adjustment spring are butted with the first annular sections of the password adjustment wheels and the corresponding spacer respectively.

4. The composite coded lock for a bag according to claim 3, wherein the lock core of the key lock is fixed on the bottom shell through a lock sleeve of the key lock and disposed on one side of the lock core casing; and a push block used for pushing the controlled portion of the lock blade is formed on the end portion of the lock core.

5. The composite coded lock for a bag according to claim 4, wherein the controlled portion has an inclined plane engaged with the push block or the push block has an inclined plane engaged with the controlled portion.

6. The composite coded lock for a bag according to claim 1, wherein the clamping pedestal also has a surface shell; one end of the locking piece close to the locking device is articulated with one end of the surface shell; both the locking piece and the surface shell are provided with coaxial through holes; pin shafts are inserted into the through holes, so that the locking piece is articulated with the surface shell; the other end of the surface shell is slideably connected with the push and control block which has a clamping portion; the clamping pedestal is provided with a clamping hole engaged with the clamping portion which is butted with one end of the linkage; the linkage prevents the clamping portion of the push and control block from being removed from the clamping hole; a connecting piece is formed between the surface shell and the locking piece and lapped with the locking piece; one end of the connecting piece far away from the locking device is a fixed end having a shoulder; a connecting block is formed between the shoulder and the surface shell; both ends of the connecting block are respectively articulated with the central section of the surface shell and the shoulder; and the connecting piece is connected with the clamping pedestal.

7. The composite coded lock for a bag according to claim 6, wherein the fixed end of the connecting piece is curved towards the surface shell to form a stop block; a fixing rod is arranged between the connecting piece and the surface shell; both ends of the fixing rod are fixed on the clamping pedestal; and the fixing rod is clamped with the stop block of the fixed end.

8. The composite coded lock for a bag according to claim 1, wherein the composite coded lock for a bag also comprises a main surface shell and side surface shells, which are engaged with the bottom shell, and a handle; a through hole for the password wheels and the lock core to be exposed is formed in the middle of the main surface shell; mounting holes for the handle to be mounted into are formed on both sides of the main surface shell; and the handle is articulated with the main surface shell through the mounting holes.

9. The composite coded lock for a bag according to claim 1, wherein an offsetting elastic component is arranged between the linkage and the bottom shell or the clamping pedestal.

* * * * *